US005867754A

United States Patent [19]

Endo et al.

[11] Patent Number: 5,867,754

[45] Date of Patent: Feb. 2, 1999

[54] IMAGE-FORMING MACHINE WITH DETACHABLE DEVELOPING DEVICE

[75] Inventors: Hirohisa Endo; Shinsuke Kawashima; Shinichi Kotera, all of Osaka, Japan

[73] Assignee: Mita Industrial Co., Ltd., Osaka, Japan

[21] Appl. No.: 996,236

[22] Filed: Dec. 22, 1997

[30] Foreign Application Priority Data

Dec. 27, 1996 [JP] Japan ..... 8-356711

[51] Int. Cl.[6] ..... G03G 15/04

[52] U.S. Cl. ..... 399/119; 399/120; 399/279

[58] Field of Search ..... 399/119, 120, 399/110, 107, 222, 252, 258, 265, 279, 286

[56] References Cited

U.S. PATENT DOCUMENTS 5,678,148 10/1997 Owada et al. ..... 399/279

*Primary Examiner*—Arthur T. Grimley
*Assistant Examiner*—Hoan Tran
*Attorney, Agent, or Firm*—Beveridge, DeGrandi, Weilacher & Young, LLP

[57] ABSTRACT

An image-forming machine having a photosensitive drum disposed in the machine housing, a movable mounting plate disposed in the machine housing so as to be moved toward, and away from, the photosensitive material drum, a developing device detachably mounted on the movable mounting plate from the front side of the machine housing, and a push-operation mechanism for moving the developing device and the movable mounting plate between a push position close to the photosensitive material drum and a push-release position moved away from the push position. A separator wall is provided in the direction of width on the bottom wall that constitutes the developing housing of the developing device to partition a conveying passage of the stirring/conveying device, and guide grooves are formed in the bottom surface of the bottom wall provided with the separator wall, the guide grooves extending from an end of the back side toward the front side, and operation pins constituting the push-operation mechanism are fitted into the guide grooves formed in the bottom wall constituting the developing housing through guide holes formed in the movable mounting plate.

2 Claims, 12 Drawing Sheets

IMAGE-FORMING MACHINE WITH DETACHABLE DEVELOPING DEVICE

FIELD OF THE INVENTION

The present invention relates to an image-forming machine such as an electrostatic copier or an electrostatic printer. More specifically, the invention relates to an image-forming machine which is so constituted that a developing device can be detachably mounted on a machine housing, and to a developing device used in the image-forming machine.

DESCRIPTION OF THE PRIOR ART

An image-forming machine such as an electrostatic copier or an electrostatic printer is equipped with a developing device for developing, into a toner image, an electrostatic latent image formed on a photosensitive material drum which is an image carrier disposed in the machine housing. The developing device has been put into a practical use in such a system that the developing device is replaced as a unit every after it is operated for a predetermined period of time. In order that the developing device can be easily replaced, a constitution has been employed which permits the developing device to be detachably mounted on the machine housing. For this purpose, in general, a system has been employed which permits the developing device to be inserted from the front side toward the back side of the machine housing. In order that the developing device can be supported maintaining a freedom of movement in the back-and-forth direction, there have been put into practical use a system in which edges on both sides of the developing device are inserted in a support member having guide rails on both sides thereof that is arranged in the machine housing, so that the developing device is suspended by the support member; and a system according to which the machine housing is equipped with a support member that is formed to meet the shape of a developing housing of the developing device and the developing device is placed on the support member.

However, the system which suspends the developing device using a support member loses stability at the time when the developing device is to be inserted, and further causes the portions at which the developing device is inserted in the guide rails of the developing housing to be abraded by the guide rails. According to the system in which the support member is formed to meet the shape of the developing housing of the developing device, on the other hand, stability is maintained at the time when the developing device is inserted but the support member must be made of a synthetic resin resulting in an increase in the cost of production and in an increase in the size. Besides, at the time of forming an image, the developing device must be pushed onto a push position close to the photosensitive material drum. To take out the developing device, furthermore, the developing device must be moved to a push-release position away from the push position. Therefore, a push-operation mechanism must be coupled to the support member for moving the developing device toward, and away from, the photosensitive material drum, by using a coupling unit of a complex shape.

SUMMARY OF THE INVENTION

It is an object of the present invention to provide an image-forming machine capable of stably inserting and pulling out a developing device without using a large or a complex support member for supporting the developing device, and to provide a developing device for use in the image-forming machine.

In order to achieve the above-mentioned object according to the present invention, there is provided an image-forming machine comprising:

a machine housing;

a photosensitive drum disposed in said machine housing;

a movable mounting plate disposed in said machine housing so as to be moved toward, and away from, said photosensitive material drum;

a developing device having a developing housing, a developing agent application means for applying a developing agent onto an electrostatic latent image formed on said photosensitive material drum disposed in said developing housing, and a stirring/conveying means for conveying the developing agent in said developing housing to said developing agent application means while stirring it, and is detachably mounted on said movable mounting plate from the front side of said machine housing; and a push-operation mechanism for moving said developing device and said movable mounting plate between a push position close to said photosensitive material drum and a push-release position moved away from said push position; wherein a separator wall is provided in the direction of width on the bottom wall that constitutes said developing housing of said developing device to separate a conveying passage of said stirring/conveying means, and guide grooves are formed in the bottom surface of said bottom wall provided with said separator wall, said guide grooves running from an end of the back side toward the front side; and operation pins constituting said push-operation mechanism are fitted into the guide grooves formed in the bottom wall constituting said developing housing through guide holes formed in said movable mounting plate.

According to the present invention, there is further provided a developing device for use in an image-forming machine and having a developing housing, a developing agent application means disposed in said developing housing, and a stirring/conveying means for conveying the developing agent in said developing housing to said developing agent application means while stirring it, said developing device for use in an image-forming machine being detachably mounted on a movable mounting plate disposed in a machine housing from the front side; wherein a separator wall is provided in the direction of width on the bottom wall that constitutes said developing housing of said developing device to separate a conveying passage of said stirring/conveying means, and guide grooves are formed in the bottom surface of said bottom wall provided with said separator wall, said guide grooves running from an end of the back side toward the front side and being fitted with operation pins that constitute a push-operation mechanism of said developing device.

DETAILED DESCRIPTION OF THE PREFERRED EMBODIMENTS

Preferred embodiments of the image-forming machine constituted according to the present invention will now be described in detail with reference to the accompanying drawings.

Figure 1:
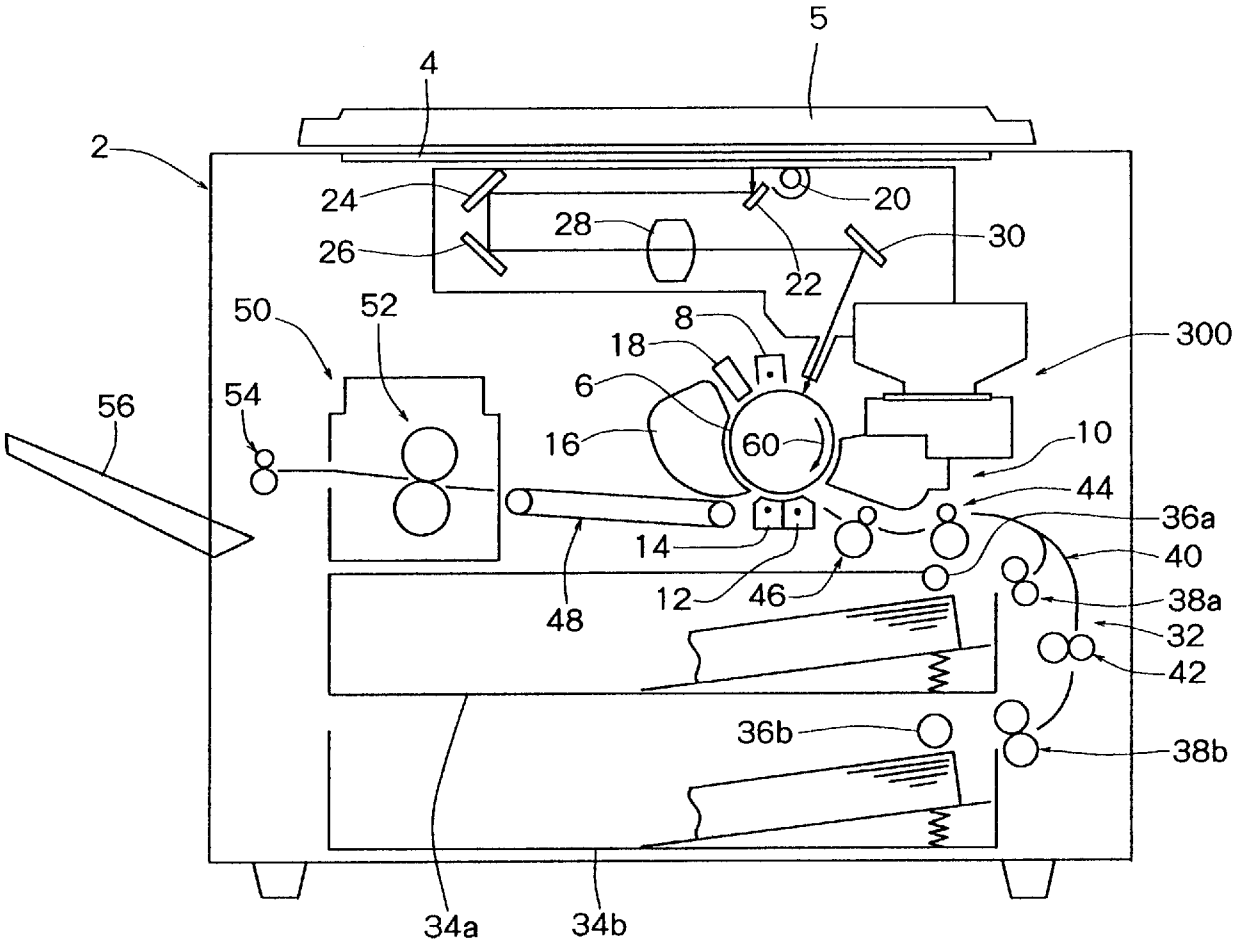
FIG. 1 is a sectional view schematically illustrating the constitution of an image-forming machine constituted according to an embodiment of the present invention.
Figure 2:
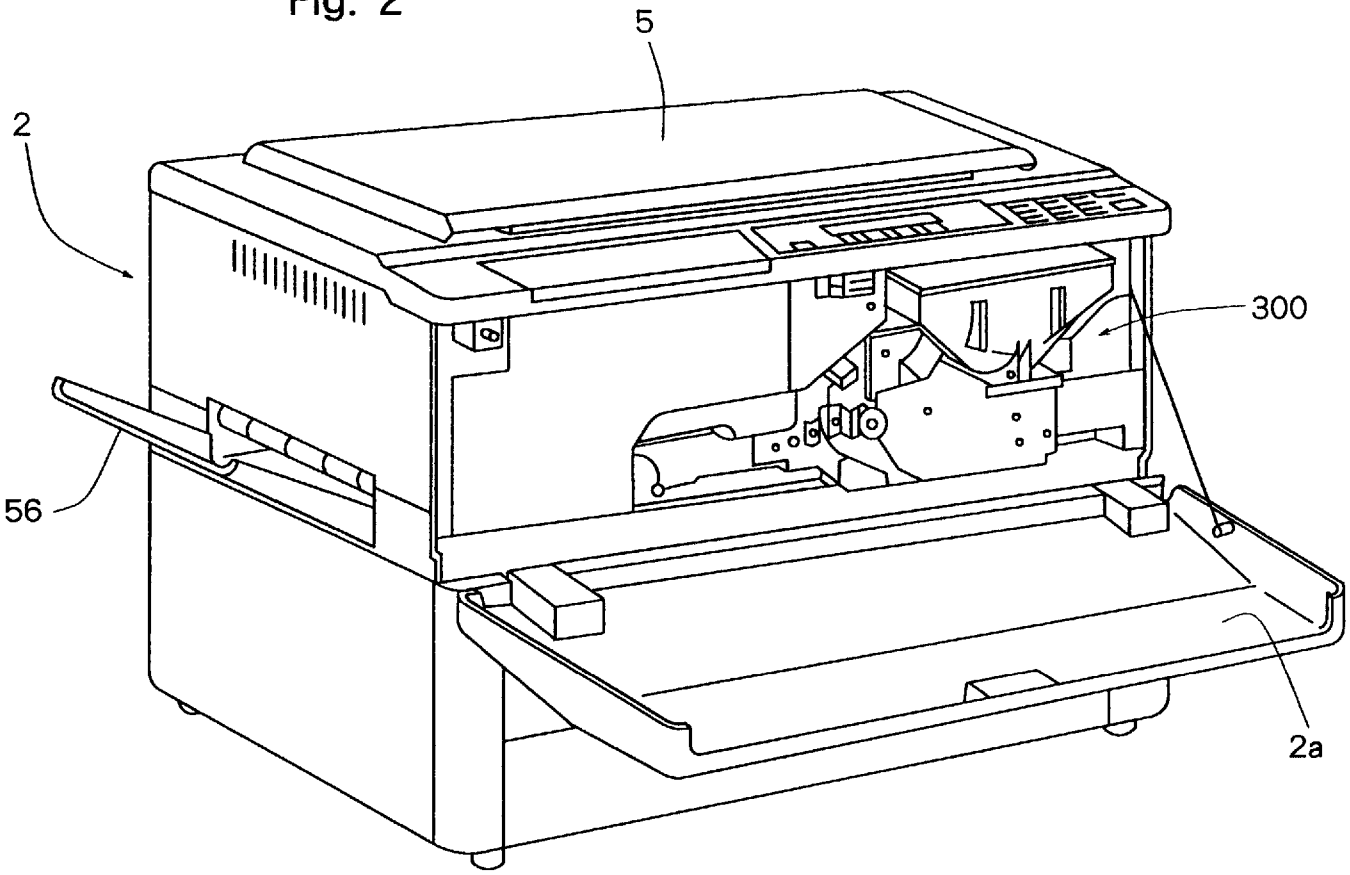
FIG. 2 is a perspective view of the image-forming machine of FIG. 1.

FIGS. 1 and 2 illustrate an electrostatic copier which is an image-forming machine constituted according to the present invention. The illustrated electrostatic copier is equipped with a machine housing 2 of a rectangular parallelopiped shape. On the upper surface of the machine housing 2 are disposed a stationary transparent plate 4 on which will be placed a document that is to be copied, and a document-holding plate 5 that can be opened and closed to cover the stationary transparent plate 4 and the document placed thereon. Nearly at the center of the machine housing 2 is rotatably disposed a photosensitive material drum 6 as shown in FIG. 1. The photosensitive material drum 6 is rotated in a direction indicated by an arrow 60 by a drive means that is not shown. Around the photosensitive material drum 6 are disposed a corona discharger 8 for electric charging, a developing device 10, a corona discharger 12 for transfer, a corona discharger 14 for peeling, a cleaning unit 16 and a charge-removing lamp 18 in this order seen from the direction of rotation indicated by the arrow 60. The illustrated electrostatic copier is equipped, disposed above the photosensitive material drum 6, with an optical system which comprises an irradiation lamp 20,a first mirror 22, a second mirror 24, a third mirror 26, a lens 28 and a fourth mirror 30. The optical system is so constituted that the document placed on the stationary transparent plate 4 is irradiated with light from the irradiation lamp 20 and the image of reflected light is formed on the outer peripheral surface of the photosensitive material drum 8 through the first mirror 22, second mirror 24, third mirror 26, lens 28 and fourth mirror 30. The illustrated electrostatic copier is equipped with a transfer paper-feeding device 32 for feeding a transfer paper onto a transfer zone between the corona discharger 12 for transfer and the photosensitive material drum 6. The transfer paper-feeding device 32 is equipped with transfer paper cassettes 34*a*, 34*b* for accommodating transfer papers, transfer paper delivery rollers 36*a*, 36*b*, a pair of handling rollers 38*a*, 38*b*, a guide passage 40, a pair of conveyer rollers 42, 44, and a pair of resist rollers 46. The above-mentioned pairs of rollers of the thus constituted transfer paper-feeding device 32 are rotated by drive means that are not illustrated. On the side of delivering the transfer paper from the transfer zone are disposed a transfer paper conveyer belt mechanism 48, a pair of fixing rollers 52 for constituting a fixing device 50, and a pair of discharge rollers 54. The conveyer belt mechanism and the rollers are rotated by drive means that are not shown. As shown in FIG. 2, on the front surface side of the machine housing 2 in which the above-mentioned members are arranged is mounted a front cover 2*a* so as to be opened and closed with the lower edge thereof as a fulcrum.

In the thus constituted electrostatic copier, while the photosensitive material drum 6 rotates in a direction indicated by the arrow 60, the corona discharger 8 substantially uniformly charges the photosensitive material on the photosensitive material drum 6 into a predetermined polarity, the document placed on the stationary transparent plate 4 is irradiated with light from the irradiation lamp 20, the image of reflected light falls on the photosensitive material drum 6 through the first mirror 22, second mirror 24, third mirror 26, lens 28 and fourth mirror 30, so that an electrostatic latent image is formed on the photosensitive material drum 6. Thereafter, the electrostatic latent image on the photosensitive material drum 6 is developed into a toner image by the developing device 10. On the other hand, a transfer paper accommodated in the transfer paper cassette 34*a* or 34*b* of the transfer paper-feeding device 32 is delivered by the transfer paper delivery roller 36*a* or 36*b* onto the guide passage 40, halted for a moment by the pair of resist rollers 46, and is conveyed into a transfer zone in synchronism with the toner image formed on the photosensitive material drum 6. The transfer paper conveyed to the transfer zone passes through between the photosensitive material drum 6 on which the toner image is formed and the corona discharger 12 for transfer, so that the toner image is transferred thereon. The transfer paper onto which the toner image is transferred is peeled off the photosensitive material drum 6 by the action of the corona discharger 14 for peeling, conveyed by the transfer paper conveyer belt mechanism 48 to the fixing device 50 where the toner image is heated and fixed, and is discharged onto a discharge tray 56 by the pair of discharge rollers 54. After the step of transfer is finished as described above, the toner adhering on the outer peripheral surface of the photosensitive material drum 6 is removed by the cleaning unit 16. Furthermore, the surface of the photosensitive material is irradiated with light for removing electric charge from the charge-removing lamp 18, so that the electric charge is removed therefrom.

Figure 3:
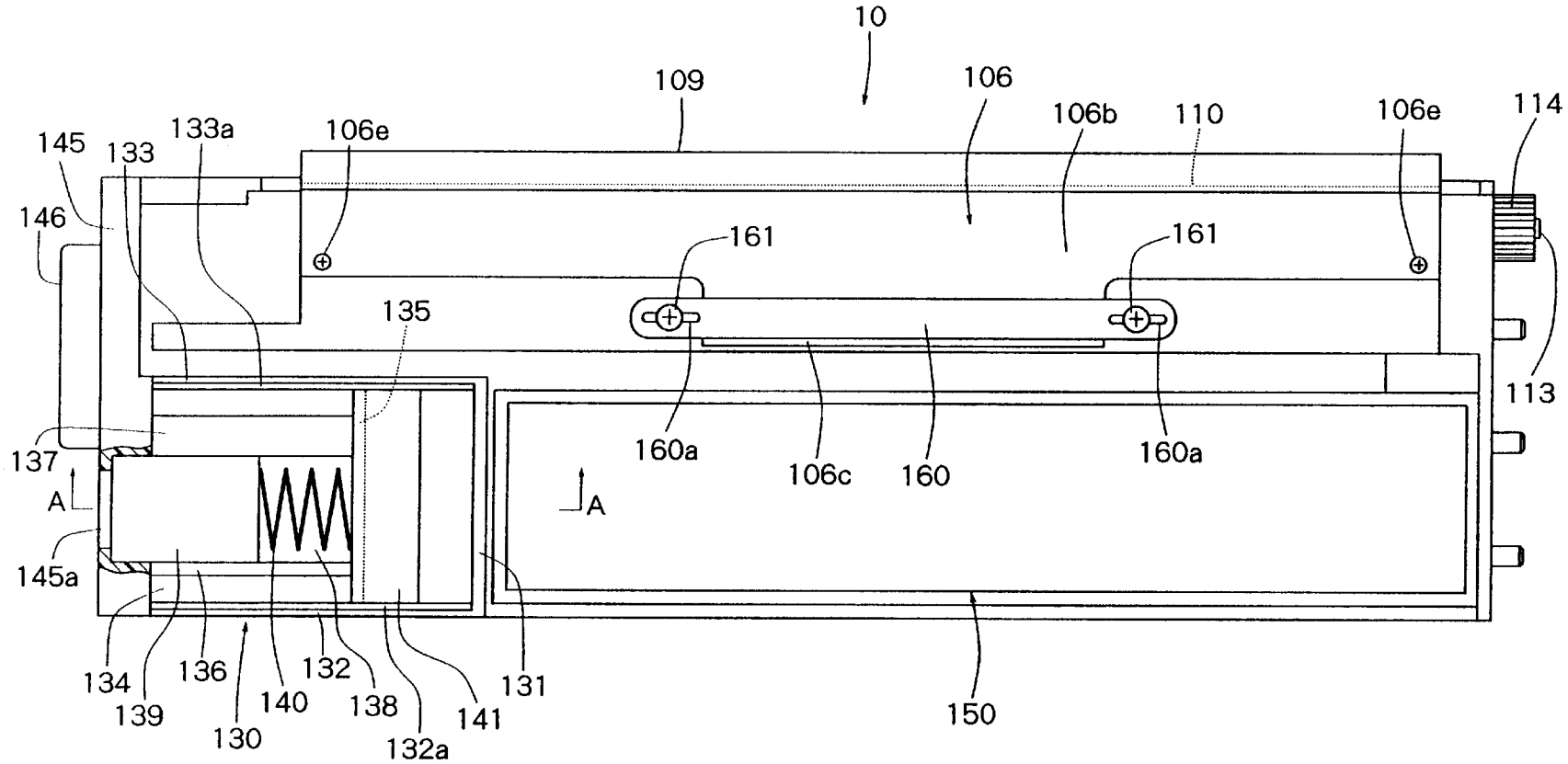
FIG. 3 is a plan view of a developing device mounted on the image-forming machine of FIG. 1.
Figure 4:
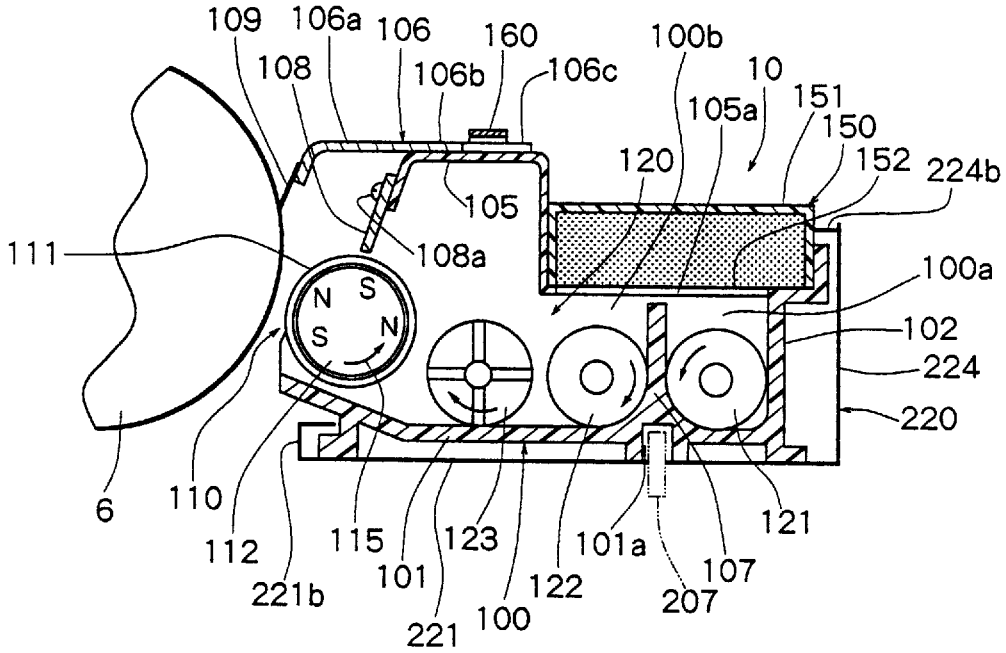
FIG. 4 is a sectional view illustrating a state where the developing device of FIG. 3 is mounted on a movable mounting plate, and shows a relationship relative to a photosensitive material drum.
Figure 5:
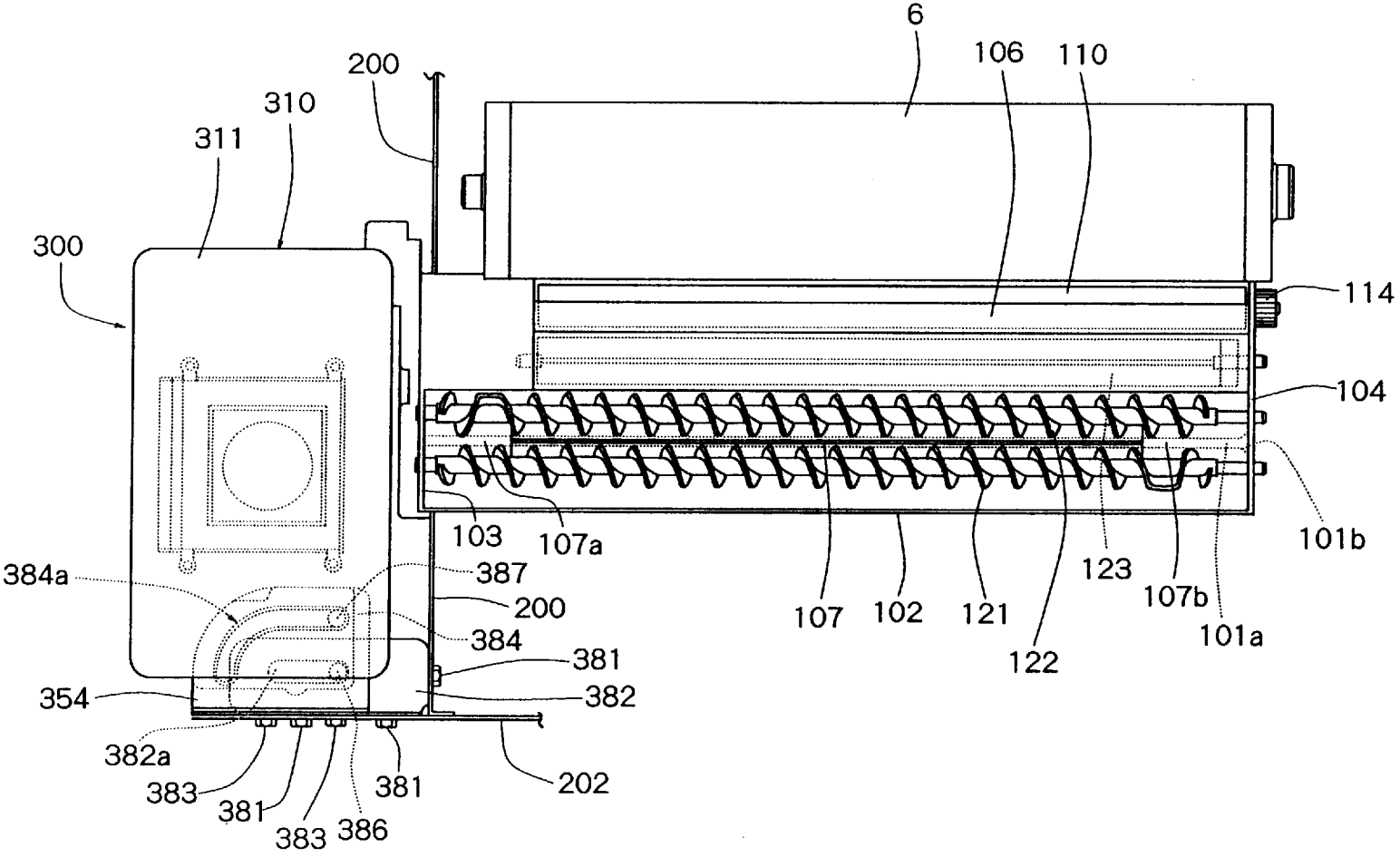
FIG. 5 is a plan view of a developing device and a toner-feeding device mounted on the image-forming machine of FIG. 1.

Next, the developing device 10 will be described with reference to FIGS. 3 to 8. The illustrated developing device 10 is equipped with a developing housing 100. The developing housing 100 that can be formed of a suitable synthetic resin includes a bottom wall 101, a rear wall 102, a front end wall 103, a rear end wall 104, and a cover wall 105 for covering the upper side of the developing housing 100. On the bottom wall 101 constituting the developing housing 100 is integrally formed a separator wall 107 in the back-and-forth direction (direction of width) (direction perpendicular to the surface of the paper in FIG. 4, or right-and-left direction in FIG. 5), and the developing housing is separated by the separator wall 107 into a first conveying passage 100*a* and a second conveying passage 100*b*. The separator wall 107 upwardly protrudes substantially vertically from the bottom wall 101 of the developing housing 100, and its both sides at the lower end portion thereof are formed in a recessed arcuate shape. Developing agent transfer ports 107*a* and 107*b* are formed at both ends of the separator wall 107 in the back-and-forth direction (direction of width), and the first conveying passage 100*a* and the second conveying passage 100*b* are communicated with each other. As shown in FIGS. 4 and 5, in the bottom wall 101 provided with the separator wall 107 is formed a guide groove 101*a* extending in the back-and-forth direction (direction the width) from the end on the back side thereof up to the end on the front side thereof. A guide portion 101*b* is formed at the end on the back side of the guide groove 101*a* (right end portion in FIG. 5) spreading toward both sides in the horizontal direction. A doctor blade plate 108 is attached by a screw 108*a* to the free end of the cover wall 105 of the developing housing 100. The lower edge of the doctor blade plate 108 is positioned close to the peripheral surface of the sleeve member 111 of a developing agent application means 110 that will be described later, and works as a so-called doctor blade means for limiting the amount of the developing agent that is conveyed to the developing zone while being held on the peripheral surface of the sleeve member 111. A doctor blade cover 106 is mounted on the upper surface of the cover wall 105. The doctor blade cover 106 includes a cover portion 106*a* and a mounting portion 106*b* as shown in FIG. 4, and is constituted by folding a plate member made of an aluminum alloy or the like. As shown in FIG. 3, a tongue piece 106*c* is formed at the center of an end portion of the mounting portion 106*b* constituting the doctor blade cover 106. The thus constituted doctor blade cover 106 is mounted at its mounting portion 106*b* on the upper surface of the cover wall 105 by using screws 106*e*, 106*e*. A sheet-like sealing member 109 is attached to a free end of the doctor blade cover 106. The sheet-like sealing member 109 is constituted by a sheet member having flexibility, such as polyethylene terephthalate (PETP) resin or the like, adhered with an adhesive to the free end of the doctor blade cover 106, and its free end is brought into slight contact with the peripheral surface of the photosensitive material drum 6. In the illustrated embodiment, a front end plate 145 is attached by a fastening means such as screws to the end on the front side of the developing housing 100. The front end plate 145 is formed of a synthetic resin, and has a grip 146 formed at a center of the lower end portion thereof as a unitary structure (see FIGS. 3 and 7).

A developing agent application means 110 is disposed at the most front portion of the developing housing 100 (at the most left portion in FIG. 4). The developing agent application means 110 is constituted by a sleeve member 111 that extends substantially horizontally in the direction of width, and a permanent magnet member 112 disposed inside the sleeve member 111. The sleeve member 111 is made of a nonmagnetic material such as aluminum and is rotatably mounted, and the permanent magnet member 112 is secured to a predetermined position. The rotary shaft 113 to which the sleeve member 111 is secured protrudes rearwardly penetrating through the rear end wall 104 of the developing housing 100, and an input gear 114 is attached to the protruded end thereof. The input gear 114 is drivably coupled to a rotary drive source (not shown) which may be an electric motor via an input gear (not shown) of the photosensitive material drum 6, and is rotated in a direction indicated by an arrow 115. A developing agent stirring/conveying means 120 is disposed on the rear side of the developing agent application means 110 (on the right in FIG. 4). In the illustrated embodiment, the developing agent stirring/conveying means 120 includes a first spiral roller 121 disposed in the first conveying passage 100*a*, a second spiral roller 122 disposed in the second conveying passage 100*b*, and a paddle roller 123 disposed between the second spiral roller 122 and the developing agent application means 110. The rotary shafts of the first spiral roller 121, second spiral roller 122 and paddle roller 123 protrude rearwardly penetrating through the rear end wall 104 of the developing housing 100, and input gears that are not shown are fitted to the protruded ends thereof, the input gears being drivably coupled to the input gear 114 of the developing agent application means 110 so as to be rotated in the directions indicated by arrows. The first spiral roller 121 rotated in the direction of arrow conveys the developing agent from the front side toward the rear side (from the left side toward the right side in FIG. 5) while stirring it, and the second spiral roller 122 conveys the developing agent from the rear side toward the front side (from the right side toward the left side in FIG. 5) while stirring it. The paddle roller 123 sends the developing agent to the developing agent application means 110 while stirring it.

Figure 6:
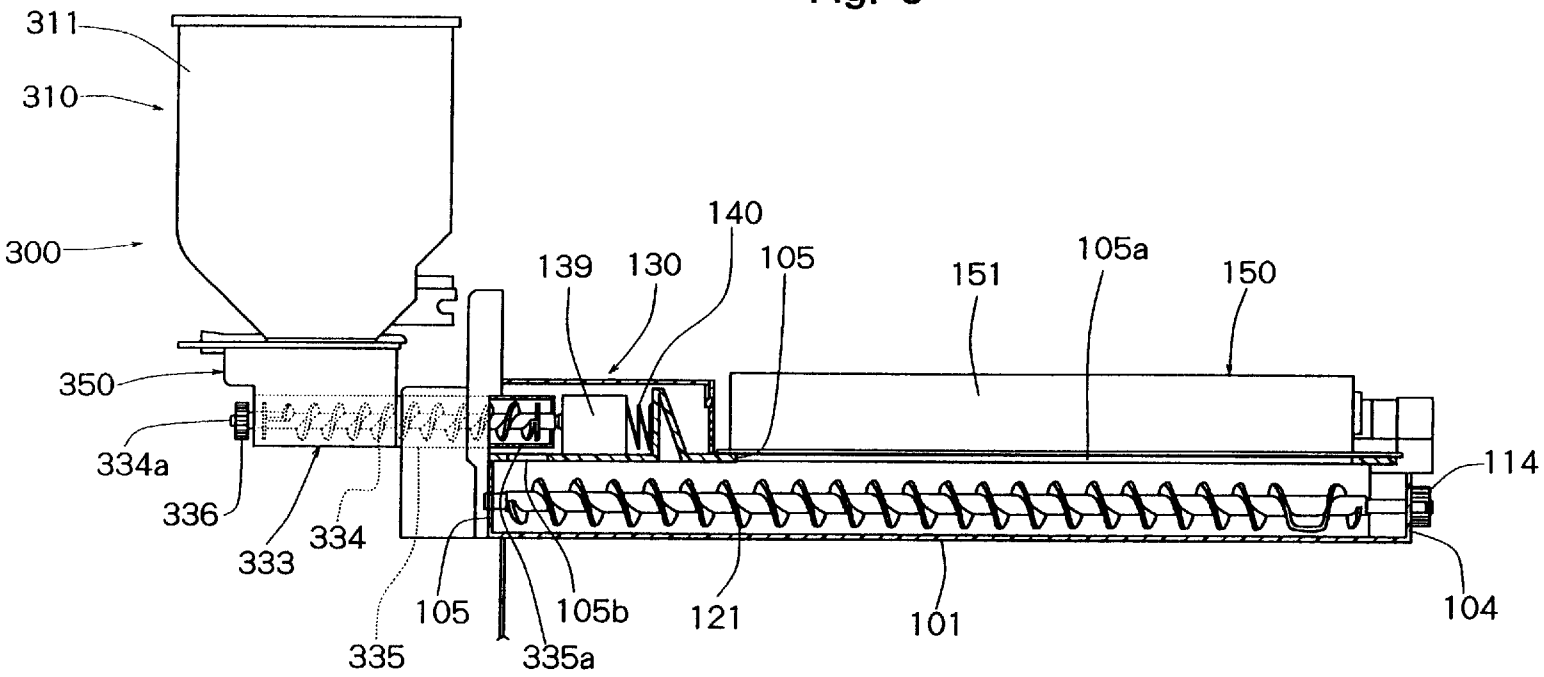
FIG. 6 is a side view illustrating, partly in a cut-away manner, the developing device and the toner-feeding device of FIG. 5.
Figure 7:
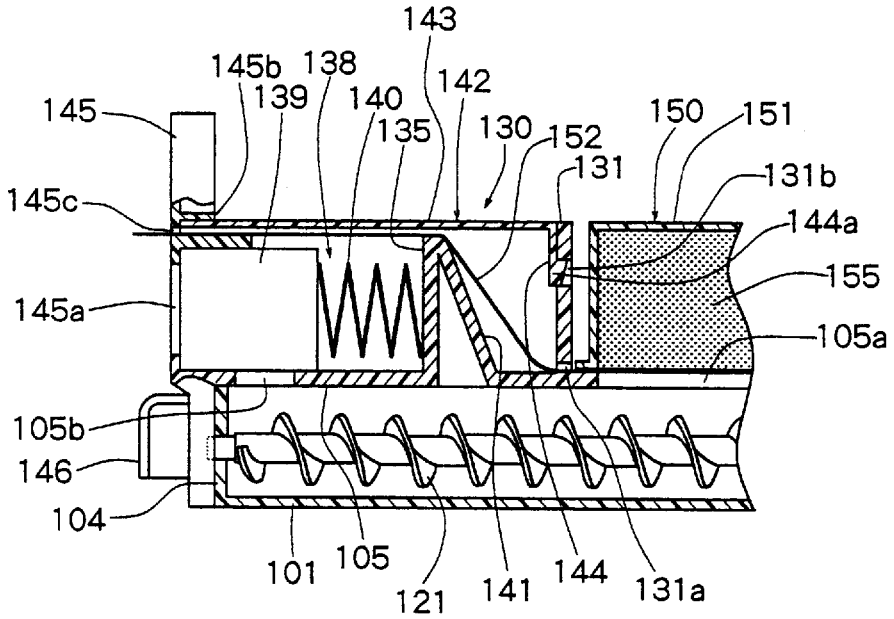
FIG. 7 is a sectional view along the line A—A in FIG. 3.

Referring to FIG. 6, a developing agent cartridge-mounting portion having a developing agent fall opening 105*a* is provided in the cover wall 105 constituting the developing housing 100 at a position opposed to the upper side of the first spiral roller 121 and the second spiral roller 122. Furthermore, a toner-feeding portion 130 is provided at a position opposed to the upper side of the first spiral roller 121 on the front side of the developing agent fall opening 105*a*. As shown in FIG. 3, the toner-feeding portion 130 has a space 134 surrounded by partitioning walls 131, 132, 133 formed erectly on the cover wall 105 and by the front end plate 145 mounted on the end on the front side of the developing housing 100. In the space 134 is provided a toner-feeding chamber 138 surrounded by separator walls 135, 136 and 137 formed erectly on the cover wall 105 and by the front end plate 145 and the cover wall 105. Referring to FIG. 7, a toner fall opening 105*b* is formed at an end on the front side of the cover wall 105 that constitutes the toner-feeding chamber 138. In the toner-feeding chamber 138 is disposed a cylindrical opening/closing valve 139 for opening and closing the toner fall opening 105*b*. A coil spring 140 is disposed between the opening/closing valve 139 and the separator wall 135, and the opening/closing valve 139 is urged toward the front end plate 145 due to the resilient force of the coil spring 140. In the front end plate 145 is formed an opening 145*a* at a position opposed to the opening/closing valve 139 and having a diameter smaller than the diameter of the opening/closing valve 139. In the space 134 constituting the toner-feeding portion 130 is provided a seal-peeling guide member 141 having a tilted surface that is tilted from the lower end of the partitioning wall 131 forming the space 134 toward the upper end of the separator wall 135 forming the toner-feeding chamber 138. Referring to FIG. 7, a seal insertion port 131*a* is formed in a lower portion of the partitioning wall 131 on the side of mounting the developing agent cartridge, that forms space 134 of the toner-feeding portion 130, and an engaging opening 131*b* is formed in an intermediate portion thereof. Stepped portions 132*a* and 133*a* are formed on the inside in the upper end portions of the partitioning walls 132 and 133 that form the space 134 of the toner-feeding portion 130.

A cover member 142 is detachably mounted on the upper side of the space 134 constituting the toner-feeding portion 130. The cover member 142 integrally formed by molding a synthetic resin includes a flat cover portion 143 and an engaging portion 144 that extends nearly at right angles from an end of the cover member 143. An engaging protrusion 144*a* is formed at an end of the engaging portion 144. To mount the thus constituted cover member 142 on the toner-feeding portion 130, the other end of the cover portion 143 is inserted in an engaging portion 145*b* formed in the front end plate 145, and the engaging portion 144 is downwardly pushed along the wall surface on the front side of the partitioning wall 131, whereby the engaging portion 144 is elastically deformed and descends, and the engaging protrusion 144*a* is brought into engagement with an engaging opening 131*b* formed in the partitioning wall 131. In this case, the lower surfaces on both sides of the cover member 142 come into contact with the stepped portions 132*a* and 133*a* formed in the partitioning walls 132 and 133. To remove the cover member 142 mounted on the toner-feeding portion 130 as described above, a screw driver or the like is inserted in the engaging opening 131*b* from the rear side of the partitioning wall 131 in a state where the developing agent cartridge that will be described later has been removed, and the engaging protrusion 144*a* is depressed. Then, the engaging portion 144 is elastically deformed and is disengaged from the engaging opening 131*b*. In this state, the engaging portion 144 is moved toward the rear side while being lifted up, and the other end of the cover portion 143 is pulled out from the engaging portion 103*b* formed in the front end wall 103.

A developing agent cartridge 150 is detachably mounted on, and is secured by a suitable fastening means to, the developing agent cartridge-mounting portion having the developing agent fall port 105*a* formed in the cover wall 105 that constitutes the developing housing 100. The developing agent cartridge 150 includes a cartridge body 151 containing a developing agent 155 which is a mixture of a carrier and a toner at a predetermined ratio, and a sealing member 152 which covers the opening formed in the lower side of the cartridge body 151 and is adhered thereto by melting or with an adhesive in a manner that it can be peeled off. The sealing member 152 is formed of a suitable synthetic resin film having flexibility such as nylon film, has an end that is stuck to the end on the front side of the cartridge body 151, stuck up to the end on the rear side of the cartridge body 151 and then, is folded back, and has the other end that is disposed on the seal-peeling guide member 141 passing through a seal insertion port 145*c* formed in a lower end portion of the partitioning wall 131. The other end of the sealing member 141 is positioned on the front side of the machine housing passing over the space 134 constituting the toner-feeding portion 130 and through the seal insertion port 145*c* formed in the front end plate 145. To mount the developing agent cartridge 150 on the developing housing 100, the cover member 142 is removed, the developing agent cartridge 150 is mounted so that the sealing member 152 is positioned on the front side of the machine housing passing over the seal-peeling guide member 141 and through the seal insertion port 145*c* formed in the front end plate 145 and then, the cover member 142 is mounted.

Figure 8:
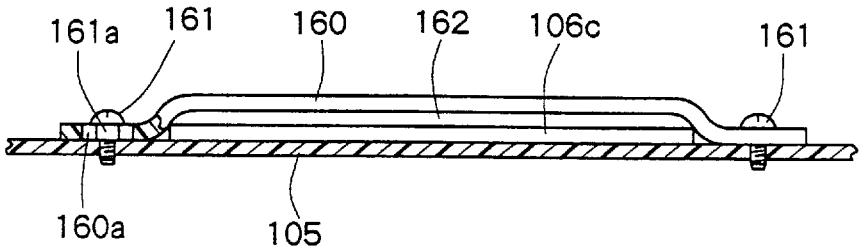
FIG. 8 is a front view illustrating, partly in a cut-away manner, a mounting state where a grip is mounted on the developing device of FIG. 3.

The thus constituted developing device 10 is detachably mounted on the machine housing 2 in a manner as will be described later. In order to facilitate the transportation of developing device 10, in this embodiment as shown in FIGS. 3, 4 and 8, a grip structure is provided on the upper surface of the cover wall 105 that constitutes the developing housing 100. The grip structure has a grip 160 constituted by a synthetic resin belt having flexibility. The grip 160 has elongated holes 160*a*, 160*a* formed at both ends thereof, and is attached to the cover wall 105 by screws 161, 161 which are mounting members disposed being inserted in the elongated holes 160*a*, 160*a*. The screws 161, 161 have stepped portions 161*a*, 161*a* thicker than the grip 160. Therefore, the grip 160 is allowed to move over a range of the elongated holes 160*a*, 160*a*. Here, the tongue piece 106*c* formed on the mounting portion 106*b* that constitutes the doctor blade cover 106 is mounted, in a state it being inserted, between the above two screws under the grip 160. With the tongue piece 106*c* being interposed between the grip 160 and the cover wall 105, the central portion of the grip 160 is floated by upper edges at both ends of the tongue piece 106*c*, and a gap 162 is formed between the grip 160 and the tongue piece 106*c*. This gap 162 makes it easy to insert finger tips between the grip 160 and the tongue piece 106*c*, so that the grip 160 can be easily held. In the illustrated embodiment, the member interposed between the grip 160 and the cover wall 105 is constituted by a part of the doctor blade cover 106 which constitutes the developing device 10. Therefore, no additional member needs be provided for forming the gap and hence, a grip structure can be made without additional cost.

Next, described below with reference to FIGS. 9 to 12 is a pushing operation mechanism for allowing the developing device 10 mounted on the machine housing 2 to move to a push position where it is brought close to the photosensitive material drum 6 or to a push-release position where it is moved away from the push position.

In the machine housing 2 are arranged a front side plate 200 and a rear side plate 201 in parallel with each other. A securing plate 203 is mounted between the front side plate 200 and the rear side plate 201 by a fastening means such as screws 204. Two operation plates 205, 205 are rotatably supported by support shafts 206, 206 on the lower side of the securing plate 203. Operation pins 207, 207 are secured to the two operation plates 205, 205. The operation pins 207, 207 upwardly protrude from the operation plates 205, 205, and are disposed penetrating through the openings 203*a*, 203*a* formed in the securing plate 203. Spring-engaging portions 205*a*, 205*a* are formed in a folded manner on the two operation plates 205, 205, and ends of tension coil springs 208, 208 which constitute a push spring means are engaged with the spring-engaging portions 205*a*, 205*a*. The other ends of the tension coil springs 208, 208 are engaged with the support brackets 209, 209 mounted on the lower surface of the securing plate 203, to turn the operation plates 205, 205 in the counterclockwise direction in FIG. 9 on the support shafts 206, 206 as centers.

An operation rod 210 is disposed on the lower side of the two operation plates 205, 205. Narrow elongated holes 210*a*, 210*a* are formed in the operation rod 210 extending in the lengthwise direction (back-and-forth direction). The operation rod 210 is allowed to move in the back-and-forth direction being supported by support pins 212, 212 secured, through the elongated holes 210*a*, 210*a*, to brackets 211, 211 mounted on the securing plate 203. The operation rod 210 has narrow elongated holes 210*b*, 210*b* formed at positions corresponding to the operation plates 205, 205 and extending in a direction at right angles with the lengthwise direction (back-and-forth direction). In the elongated holes 210*b*, 210*b* are inserted action pins 215, 215 attached at positions midway between the support shafts 206, 206 of the operation plates 205, 205 and the spring-engaging portions 205*a*, 205*a*. Therefore, when the operation rod 210 is moved in a direction indicated by an arrow 213 in FIG. 9, the operation plates 205, 205 are turned in the clockwise direction in FIG. 9 via the action pins 215, 215 with the support shafts 206, 206 as centers. When the operation rod 210 is moved in a direction indicated by an arrow 214 in FIG. 9, the operation plates 205, 205 are turned in the counterclockwise direction in FIG. 9 via the action pins 215, 215 on the support shafts 206, 206 as centers.

Figure 9:
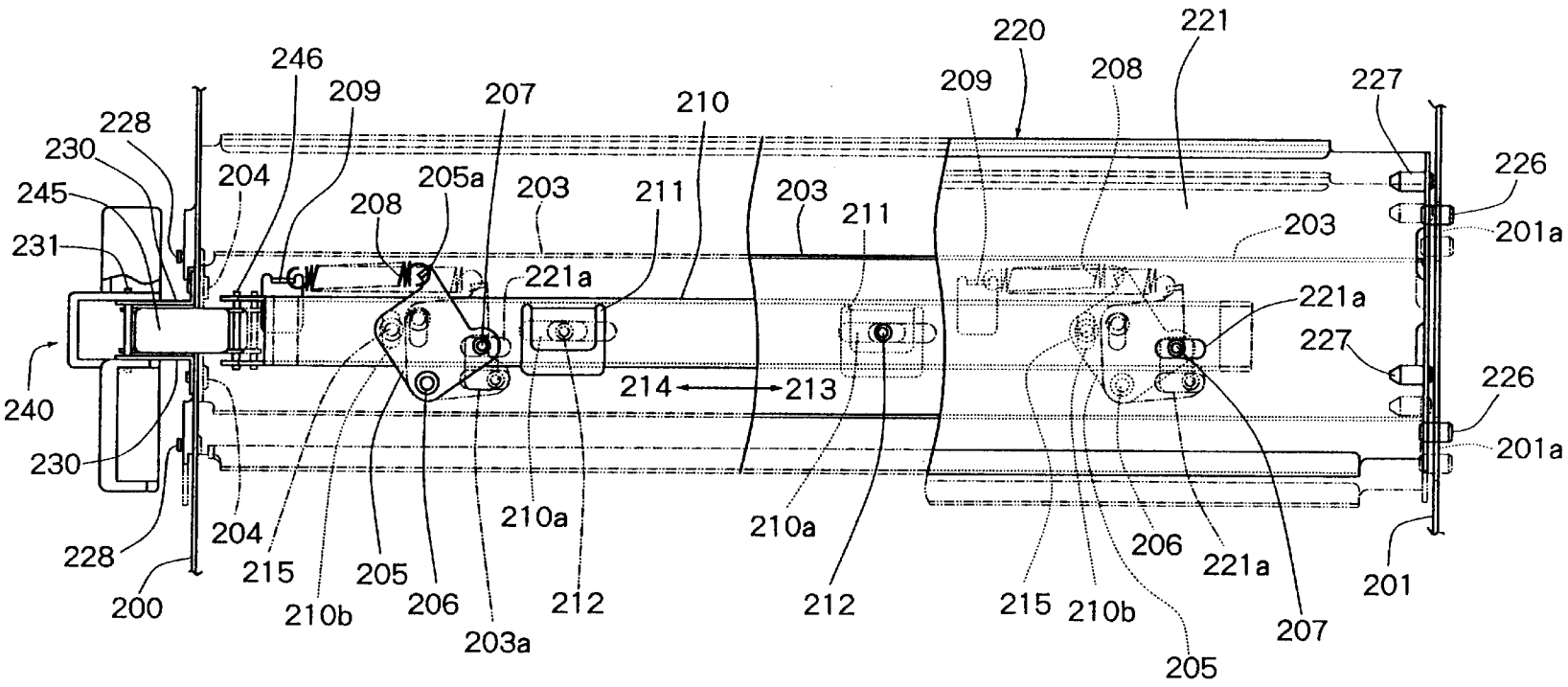
FIG. 9 is a plan view illustrating, partly in a cut-away manner, a developing device-pushing means mounted on the image-forming machine of FIG. 1.
Figure 10:
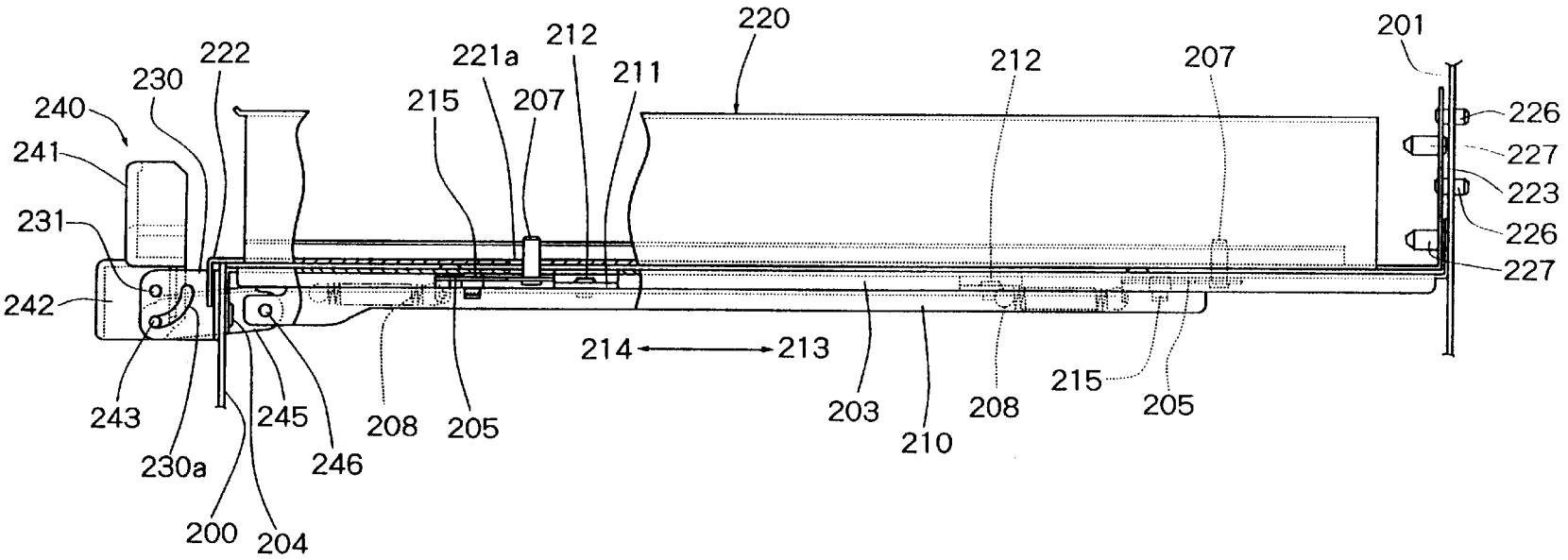
FIG. 10 is a side view illustrating, partly in a cut-away manner, a state where the developing device-pushing means of FIG. 9 is pushing.
Figure 11:
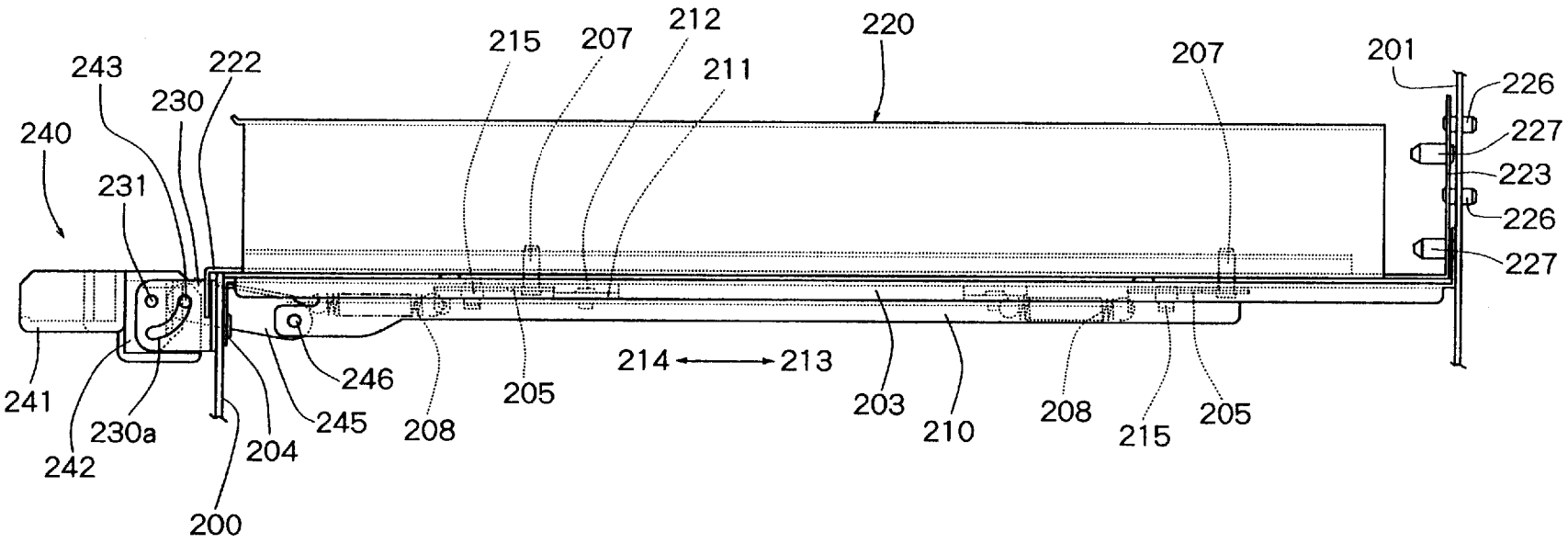
FIG. 11 is a side view illustrating a state where the developing device-pushing means of FIG. 9 is no longer pushing.

Next, described below with reference to FIGS. 9 to 11 is the pushing operation mechanism for moving the operation rod 210 in the directions of arrows 213 and 214.

A pair of L-shaped support brackets 230 and 230 are secured by screws 204, 204 that are used for fastening the securing plate 203 at a position corresponding to the operation rod 210 on the front side surface of the front side plate 200 disposed in the machine housing 2. A support pin 231 is horizontally disposed in the support brackets 230, 230 to rotatably support a push lever that will be described later. An arcuate elongated hole 230*a* is formed in the support brackets 230, 230 over an angle of about 90 degrees with the support pin 231 as a center. The push lever 240 is mounted on the thus constituted support brackets 230, 230. The push lever 240 comprises a lever portion 241 and a mounting portion 242, and is formed as a unitary structure by molding a synthetic resin. A mounting portion 242 of the push lever 240 is rotatably mounted by the support pin 231 which is attached to the support brackets 230, 230. A guide pin 243 is disposed in the mounting portion 242 of the push lever 240, and is fitted to the arcuate elongated holes 230*a* formed in the support brackets 230, 230. Therefore, as the push lever 240 is turned on the support pin 231, the guide pin 243 moves along the arcuate elongated holes 230*a*. Since the arcuate elongated holes 230*a* are formed over the angle of about 90 degrees as described above, the guide pin 243 is allowed to move over an angle of about 90 degrees, and the push lever 240 turns over an angle of about 90 degrees. That is, in the illustrated embodiment, the push lever 240 turns over a range of from a first position at which it is perpendicularly directed as shown in FIG. 10 to a second position at which it is horizontally directed as shown in FIG. 11. The thus constituted push lever 240 is coupled to the operation rod 210 through a link 245. That is, one end of the link 245 is coupled to the mounting portion 242 of the push lever 240 by the guide pin 243, and the other end of the link 245 is coupled to an end of the operation rod 210 by a coupling pin 246.

The push lever 240 is constituted as described above to constitute the pushing operation mechanism of the illustrated embodiment. Described below is a positional relationship among the support pin 231, guide pin 243 and coupling pin 246. In a state where the push lever 240 is brought to the second position to remain in a horizontal state as shown in FIG. 11, the guide pin 243 is positioned above a line that connects the coupling pin 246 to the support pin 231. Therefore, the resilient forces of the tension coil springs 208, 208 act, via the operation plates 205, 205 and the action pins 215, 215, upon the operation rod 210 to move it in the direction indicated by the arrow 214, and further act upon the guide pin 243 via the coupling pin 246 and link 245. Accordingly, the push lever 240 located at the second position as shown in FIG. 11 receives the force so as to be turned in the counterclockwise direction in FIG. 11 with the support pin 231 as a center, and is maintained in the horizontal state, i.e., maintained at the second position as shown in FIG. 11. In the state where the push lever 240 is located at the first position being vertically directed as shown in FIG. 10, the guide pin 243 is positioned below the line that connects the coupling pin 246 to the support pin 231. Therefore, the force acting on the operation rod 210 in the direction of the arrow 214 acts, via the coupling pin 246, link 245 and guide pin 243, upon the push lever 240 which is located at the first position as shown in FIG. 10 so that it turns in the clockwise direction in FIG. 10 with the pin 231 as a center. Therefore, the push lever 240 is maintained in a vertical state, i.e., maintained at the first position shown in FIG. 10. In the illustrated embodiment as described above, the push lever 240 is maintained in its state at the first position or the second position by the resilient forces of the tension coil springs 208, 208, and remains stable without having a play which might be caused by vibration or the like.

Figure 12:
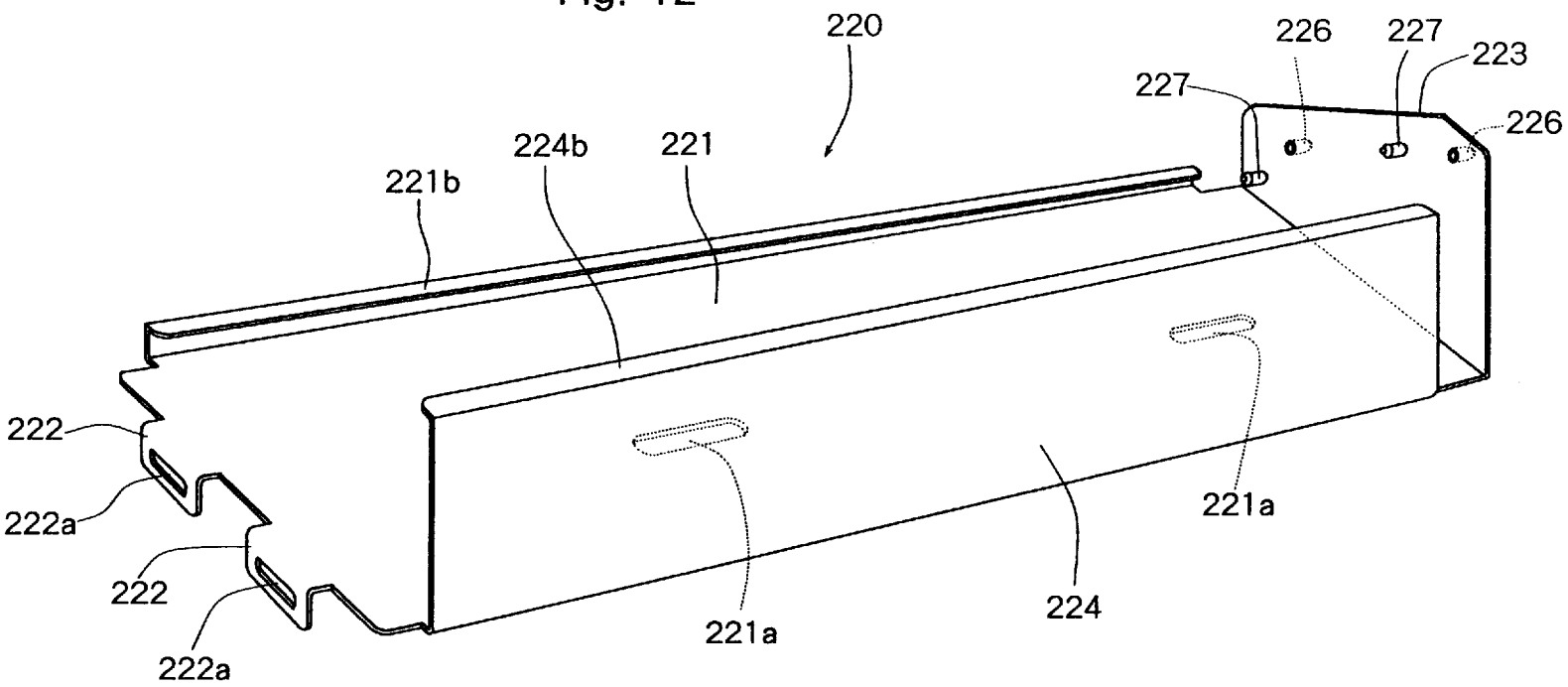
FIG. 12 is a perspective view of the movable mounting plate provided for the developing device-pushing means of FIG. 9.

A movable mounting plate 220 is disposed on the upper side of the securing plate 203. Referring to FIG. 12, the movable mounting plate 220 includes a mounting portion 221, first guide portions 222, 222 downwardly bent to protrude from the end on the front side of the mounting portion 221, a second guide portion 223 upwardly bent from the end on the rear side of the mounting portion 221, and a rear wall 224 upwardly bent from the end on the rear side of the mounting portion 221. In the mounting portion 221 constituting the movable mounting plate 220 are formed two elongated holes 221*a*, 221*a* to which the operation pins 207, 207 fit. Furthermore, a guide rail 221*b* extends in the direction of width at the edge on the side opposite to the rear wall 224 of the mounting portion 221 that constitutes the movable mounting plate 220. Elongated guide holes 222*a*, 222*a* are formed in the first guide portions 222, 222 that constitute the movable mounting plate 220. On the second guide portion 223 constituting the movable mounting plate 220 are mounted two guide pins 226, 226 that outwardly protrude, and are further mounted two positioning pins 227, 227 that inwardly protrude. A guide rail 224*b* extends in the direction of width at the upper edge of the rear wall 224 constituting the movable mounting plate 220. The first guide portions 222, 222 are placed on the upper end of the side plate 200 of the front side, the guide pins 226, 226 mounted on the second guide portion 223 are fitted to the elongated holes 201*a*, 201*a* formed in the side plate 201 of the rear side, whereby the movable mounting plate 220 is supported in a horizontal state. In this state, the guide pins 228 attached to the side plate 200 of the front side are fitted into the elongated guide holes 222*a*, 222*a* formed in the first guide portions 222, 222. Furthermore, the operation pins 207, 207 are fitted into the elongated holes 221*a*, 221*a* formed in the mounting portion 221 that constitutes the movable mounting plate 220. The developing device 10 is detachably mounted on the mounting portion 221 of the thus constituted movable mounting plate 220. To mount the developing device 10 on the mounting portion 221, the end on the rear side of the developing device 10 is placed on the front side of the mounting portion 221 and the developing device 10 is pushed toward the rear side. In this case, the developing device 10 is slid toward the rear side while the guide grooves 101*a* formed in the bottom wall 101 of the developing housing 100 are being fitted to the operation pins 207, 207. When the developing device 10 is pushed up to a predetermined position, positioning holes (not shown) formed in the rear end wall of the developing device 10 fit to two positioning pins 227, 227 attached to the second guide portion 223 that constitutes the movable mounting plate 220; i.e., the developing device 10 is mounted on the movable mounting plate 220 at a predetermined position.

Next, described below is a positional relationship between the push lever 240 and the movable mounting plate 220 movably disposed at a predetermined position in the machine housing 2. In a state where the push lever 240 is vertically positioned at the first position as shown in FIG. 10, a portion thereof (lever portion 241 in the illustrated embodiment) is positioned above the upper surface (mounting surface) of the movable mounting plate 220. In the state where the push lever 240 is at the first position, therefore, it is not allowed to mount the developing device 10 on the movable mounting plate 220 or to remove it therefrom. In the state where the push lever 240 is at the first position in the illustrated embodiment, the lever portion 241 of the push lever 240 is at a position opposed to the grip 146 provided on the front end plate 145 that constitutes the end of the front side of the developing device 10 mounted on the movable mounting plate 220. In the state where the push lever 240 is at the first position, therefore, it is not allowed to hold the grip 146 that is used for drawing the developing device 10 out of the machine housing 2. On the other hand, in a state where the push lever 240 is horizontally positioned at the second position as shown in FIG. 11, it is positioned nearly in flush with the upper surface (mounting surface) of the movable mounting plate 220. In the state where the push lever 240 is at the second position, therefore, the developing device 10 can be mounted on the movable mounting plate 220 or can be removed therefrom, and the push lever 240 works as a guide terrace at the time when the developing device 10 is mounted or removed. The push lever 240 at the second position working as a guide terrace is urged by the tension coil springs 208, 208 so as to be held at the second position, and remains stable without having a play, enabling the developing device 10 to be easily mounted or removed.

Next, described below with reference to FIGS. 5, 6, 13 and 14 is a toner-feeding device for feeding the toner to the developing device 10.

The toner-feeding device 300 is disposed on the front side (left side in FIGS. 5, 6 and 13) of the front side plate 200 of the machine housing 2. The toner-feeding device 300 in the illustrated embodiment includes a toner cartridge 310, a hopper 330 for detachably mounting the toner cartridge 310, a hopper-support housing 350 for accommodating and supporting the hopper 330, and an opening/closing support means 380 for supporting the hopper-support housing 350 in the machine housing 2 so as to allow it to turn on a horizontal plane.

The toner cartridge 310 may be constituted in a known manner, and is equipped with a toner cartridge body 311 containing toner. An opening (not shown) is formed in the bottom wall of the toner cartridge body 311, and a film-like sealing member (not shown) is fitted to the bottom surface of the bottom wall to close the opening but in such a manner that it can be peeled off. The sealing member is so constructed to be peeled off using a seal-winding means that is not shown after it has been fitted to the hopper 330.

The hopper 330 is equipped with a hopper body 331, a toner cartridge-mounting portion 332 which is provided at an upper part of the hopper body 331 to detachably mount the toner cartridge 310, and a toner conveying means 333 which is disposed at a lower part of the hopper body 331 to convey the toner to the developing device 10. The toner conveying means 333 includes a spiral roller 334 which is so disposed as to horizontally protrude from the lower part of the hopper body 331, and a guide cylinder 335 fitted to the protruded portion of the spiral roller 334. A toner discharge port 335*a* is formed in the lower side of an end of the guide cylinder 335. An input gear 336 drivably coupled to a drive means that will be described later, is fitted to a rotary shaft 334*a* of the spiral roller 334 that constitutes the toner conveying means 333.

The hopper support housing 350 is constituted, like a box, by a bottom wall 351, a front wall 352, a rear wall 353 and a side wall 354. In the front wall 352 is formed an opening through which a protruded part of the spiral roller 334 is allowed to pass. A mounting plate 356 having an opening at the central portion thereof is mounted on the upper end of the thus constituted hopper support housing 350, and the hopper 330 is mounted to the mounting plate 356. In the hopper support housing 350 is disposed a drive means 360 for driving the spiral roller 334. The drive means 360 is constituted by an electric motor 361, a drive gear 362 fitted to the rotary shaft of the electric motor 361, a first intermediate gear 363 that meshes with the drive gear 362, and a second intermediate gear 364 that meshes with the first intermediate gear 363 and the input gear 336 of the spiral roller 334.

The opening/closing support means 380 includes a support member 382 mounted on the side plate 200 of the front side and on the rear side plate 202 in the machine housing 2 by using a fastening means 381 such as bolts and nuts, and an opening/closing guide member 384 disposed on the upper side of the support member 382 and is mounted on the rear side plate 202 by a fastening means 383 such as bolts and nuts. In the support member 382 is formed a first straight guide hole 382*a* that is narrowly formed to extend in the back-and-forth direction of the machine housing (in the right-and-left direction in FIGS. 5 and 14). In the opening/closing guide member 384 is formed a second guide hole 384*a* having a straight portion 384*b* formed in parallel with the first guide hole 382*a* formed in the support member 382, and an arcuate portion 384*c* formed continuing to the end on the front side (left end in FIGS. 5 and 14) of the straight portion 384*b*. Described below is a relationship between the second guide hole 384*a* and the first guide hole 382*a*. The straight portion 384*b* constituting the second guide hole 384*a* has a length equal to the length of the first guide hole 382*a*, and an arcuate portion 384*c* constituting the second guide hole 384*a* is formed in an arcuate shape over an angle of about 90 degrees with the front end of the first guide hole 382*a* as a center and with the distance between the first guide hole 382*a* and the straight portion 384*b* of the second guide hole 384*a* as a radius.

Into the first guide hole 382*a* is movably fitted a first guide pin 386 attached to a support plate 385 mounted on the bottom wall 351 that constitutes the hopper support housing 350, and into the second guide hole 384*a* is movably fitted the second guide pin 387 attached to a mounting plate 356 mounted on the upper end of the hopper support housing 350. The first guide pin 386 and the second guide pin 387 are so disposed as to be positioned at the rear end of the first guide hole 382*a* and at the rear end of the straight portion 384*b* of the second guide hole 384*a* in a state where the toner-feeding device 300 is at the acting position shown in FIGS. 4, 5 and 13. Therefore, when the toner-feeding device 300 is pulled to the front side (left side in FIGS. 5, 6 and 14) from the acting position, the first guide pin 386 and the second guide pin 387 move up to the ends of the front side along the first guide hole 382*a* and the straight portion 384*b* of the second guide hole 384*a*. In this state, when the toner-feeding device 300 is turned in the counterclockwise direction in FIG. 14 on the first guide pin 386 as a center, the second guide pin 387 moves along the arcuate portion 384*c* constituting the second guide hole 384*a*, and is limited from moving upon coming into contact with the end of the arcuate portion 384*c* at an open position after having moved by an angle of about 90 degrees as shown in FIG. 14. Thus, the hopper 330 constituting the toner-feeding device 300 moves toward the front side of the machine housing 2 by a predetermined distance from the acting position and then, turns at the turning position on a horizontal plane. In a state where the hopper 330 is at the acting position, the front end of the toner conveying means 333 is positioned, as shown in FIG. 6, in the toner-feeding chamber 138 by pushing back the opening/closing valve 139 disposed in the toner-feeding chamber 138 in the toner-feeding portion 130 of the developing device 10.

The image-forming machine according to the present invention is constituted as described above. Described below is its function.

Figure 13:
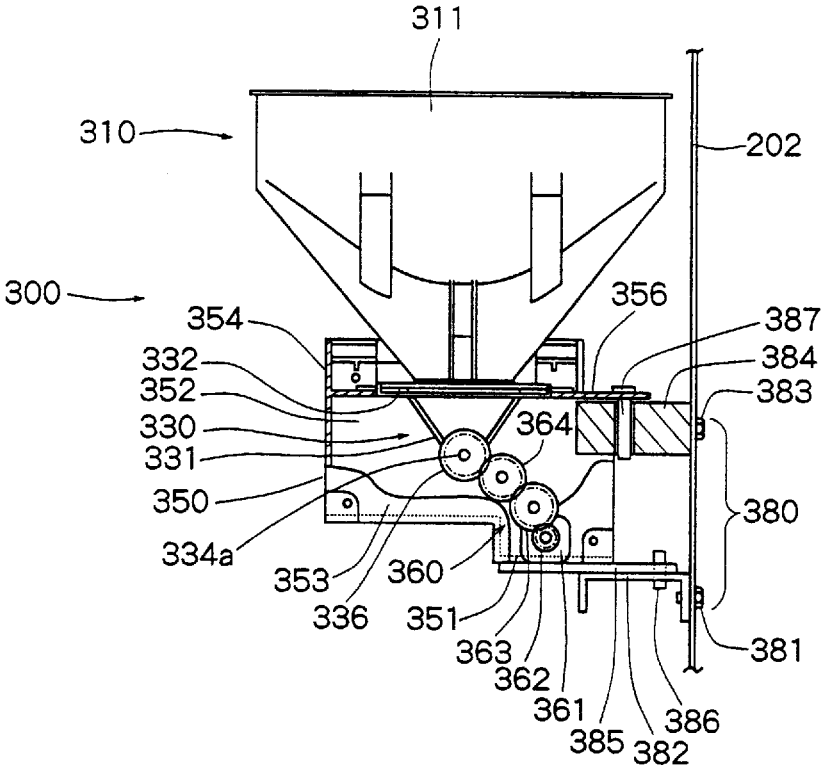
FIG. 13 is a front view illustrating, in a cut-away manner, the toner-feeding device shown in FIG. 5.
Figure 14:
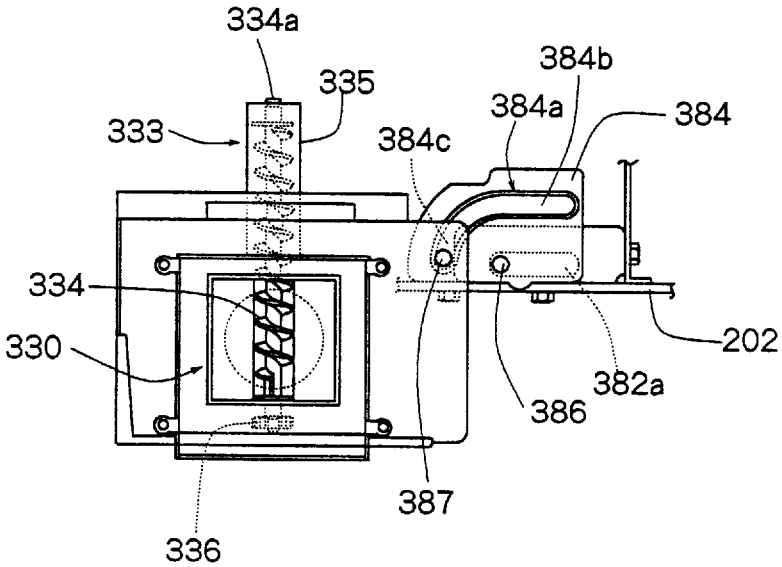
FIG. 14 is a plan view illustrating a state where a hopper constituting the toner-feeding device of FIG. 5 is moved to an open position.

To conduct the replacement of the developing device 10, the front cover 2*a* mounted on the front surface side of the machine housing 2 is opened as shown in FIG. 2, and the hopper 330 constituting the toner-feeding device 300 is moved toward the front side of the machine housing 2 from the acting position shown in FIGS. 5, 6 and 13 by a predetermined distance (length of the first guide hole 382*a* and of the straight portion 384*b* constituting the second guide hole 384*a*). Then, the end of the toner conveying means 333 escapes from the toner-feeding portion 130 of the developing device 10. Therefore, the toner-feeding device 300 is allowed to turn without causing the end of the toner conveying means 333 to interfere with the developing device 10. The toner-feeding device 300 is pulled toward the front side of the machine housing 2 by a predetermined distance, and is turned in the counterclockwise direction in FIG. 13 on the first guide pin 386 as a center. Then, the second guide pin 387 moves along the arcuate portion 384*c* that constitutes the second guide hole 384*a*, and is limited from moving upon coming into contact with an end of the arcuate portion 384*c* at the open position after having moved by an angle of about 90 degrees as shown in FIG. 14. In this state, the front side of the developing device 10 in the machine housing 2 is opened.

Next, as the push lever 240 constituting the pushing operation mechanism is turned downwards toward the front side from the vertical state at the first position shown in FIGS. 9 and 10 on the support pin 231 as a center (counterclockwise direction with the support pin 231 as a center in FIG. 10), the guide pin 243 moves along the arcuate elongated hole 230*a*. When turned by an angle of about 90 degrees, the guide pin 243 comes into contact with the end of the arcuate elongated hole 230*a*, and the push lever 240 is horizontally positioned at the second position as shown in FIG. 11. With the push lever 240 being brought to the second position shown in FIG. 11, the front side of the developing device 10 is opened at the front side plate 200 of the machine housing 2. With the motion of the push lever 240 to the second position, the operation rod 210 is moved in the direction indicated by the arrow 213 in FIGS. 10 and 11 via the guide pin 243, link 245 and coupling pin 246. As the operation rod 210 moves in the direction indicated by the arrow 213 in FIGS. 10 and 11, the operation plates 205, 205 are turned in the clockwise direction in FIG. 9 via the action pins 215, 215 on the support shafts 206, 206 as centers. Thereby, the operation pins 207, 207 mounted on the operation plates 205, 205 turn in the clockwise direction in FIG. 9 on the support shafts 206, 206 as centers. Accordingly, the movable mounting plate 220 having elongated holes 221*a*, 221*a* and guide grooves 101*a* fitted to the operation pins 207, 207, and the developing device 10 having the developing housing 100, are moved rightwards in FIGS. 4 and 9, and the developing device 10 is moved away from the photosensitive material drum 2 and is brought to the push-release position (detaching/attaching position).

In this state, when the developing device 10 is pulled forward with the grip 146 provided on the front end plate 145, it can be pulled to the front side of the machine housing 2 being guided by the push lever 240 that is horizontally positioned at the second position. At this time, when the developing device 10 is pulled to some extent out of the developing housing 100, finger tips can be inserted in the gap 162 formed between the tongue piece 106*c* and the grip 160 mounted on the upper surface of the cover wall 105 constituting the machine housing 2 of the developing device 10, so that the developing device 10 can be easily pulled out by holding the grip 160. Thus, when the push lever 240 is not brought to the second position where it is horizontally positioned as shown in FIG. 11, the front side of the developing device 10 at the front side plate 200 of the machine housing 2 is not opened, i.e., the developing device 10 does not appear. That is, it is not allowed to pull out the developing device 10 unless the push lever 240 is brought to the second position so that the developing device 10 is no longer pushed onto the photosensitive material drum 6. At the time of pulling out the developing device 10, therefore, the sleeve member 111 constituting the developing agent application means 110 of the developing device 10 is necessarily separated away from the photosensitive material drum 6 and hence, the photosensitive material drum 6 is never rubbed by the sleeve member 111. Thus, the photosensitive material drum 6 and the sleeve member 111 are prevented from being damaged.

After the used developing device 10 is pulled out from the machine housing 2, a new developing device 10 is placed on the mounting portion 221 of the movable mounting plate 220 disposed in the machine housing 2. To mount the developing device 10 on the mounting portion 221, while the push lever 240 is maintained horizontal at the second position shown in FIG. 11, the rear end of the developing device 10 is placed on the front side of the mounting portion 221, and is pushed toward the rear side along the guide rails 221*b*, 224*b*. At this time, the developing device 10 is slid toward the rear side while the guide grooves 101*a* formed in the bottom wall 101 of the developing housing 100 are being fitted to the operation pins 207, 207. After the developing device 10 is pushed up to a predetermined position, positioning holes (not shown) formed in the rear end wall of the developing device 10 are fitted to the two positioning pins 227, 227 mounted on the second guide portion 223 constituting the movable mounting plate 220, and the developing device 10 is mounted on the movable mounting plate 220 at a predetermined position.

After the new developing device 10 is mounted at a predetermined position on the movable mounting plate 220 disposed in the machine housing 2, the push lever 240 constituting the pushing operation mechanism is upwardly turned from the second position where it is horizontally positioned as shown in FIG. 11 on the support pin 231 as a center (turned clockwise on the support pin 231 as a center in FIG. 11). Then, the guide pin 243 moves along the arcuate elongated hole 230*a*. After having turned by an angle of about 90 degrees, the guide pin 243 comes into contact with the end of the arcuate elongated hole 230*a* to arrive at the first position where the push lever 240 is vertically positioned as shown in FIG. 10. With the turn of the push lever 240 to the first position, the operation rod 210 is moved in the direction indicated by the arrow 214 in FIGS. 10 and 11 via the guide pin 243, link 245 and coupling pin 246. As the operation rod 210 moves in the direction indicated by the arrow 214 in FIGS. 10 and 11, the operation plates 205, 205 are turned in the counterclockwise direction in FIG. 9 via the action pins 215, 215 on the support shafts 206, 206 as centers. Thereby, the operation pins 207, 207 mounted on the operation plates 205, 205 turn in the counterclockwise direction in FIG. 9 on the support shafts 206, 206 as centers. Therefore, the movable mounting plate 220 having the elongated holes 221*a*, 221*a* and guide grooves 101*a* fitted to the operation pins 207, 207 and the developing device 10 having the developing housing 100 move toward the right in FIGS. 4 and 9, and the developing device 10 is brought to the push position where it is pushed toward the photosensitive material drum 2. In the state where the developing device 10 is brought to the push position as described above, the push lever 240 is vertically positioned at the first position. Therefore, it is not allowed to pull out the developing device 10 which is at the push position.

Next, as the toner-feeding device 300 is turned in the clockwise direction in FIG. 14 from the open position on the first guide pin 386 as a center, the second guide pin 387 moves along the arcuate portion 384*c* that constitutes the second guide hole 384*a*, and is limited from moving upon coming into contact with the straight portion 382*b* constituting the second guide hole 384*a* after having moved by an angle of about 90 degrees. As the toner-feeding device 300 is rearwardly pushed in this state, the first guide pin 386 and the second guide pin 387 move toward the rear side along the first guide hole 382*a* and the straight portion 384*b* constituting the second guide hole 384*a*, and are brought to the acting position shown in FIGS. 5, 6 and 13 in a state of being brought in contact with the rear end. When the toner-feeding device 300 is brought to the acting position, the end of the toner conveying means 333 moves back the opening/closing valve 139 disposed in the toner-feeding chamber 138 in the toner-feeding portion 130 of the developing device 10 overcoming the force of the coil spring 140, and is positioned in the toner-feeding chamber 138. In bringing the toner-feeding device 300 to the acting position, the push lever 240 is brought to the first position at which it is vertically positioned as shown in FIG. 10. Otherwise, the toner-feeding device 300 interferes with the push lever 240 and is not brought to the acting position. Therefore, it does not happen that the operator forgets to bring the developing device 10 to the push position where it is pushed toward the photosensitive material drum 6. After the toner-feeding device 300 is brought to the acting position, the front cover 2*a* mounted in front of the machine housing 2 is upwardly turned and is closed from the open state that is shown in FIG. 2, making it possible to carry out the copying operation again.

Next, described below is the operation for replacing the developing agent cartridge 150 only.

After the developing device 10 is pulled out from the machine housing 2 as described above, the developing agent cartridge 150 mounted on the cover wall 105 constituting the developing housing 100 is removed. Then, for example, a screw driver is inserted in the engaging opening 131*b* from the rear side of the partitioning wall 131 constituting the toner-feeding portion 130, and the engaging protrusion 144*a* of the cover member 142 is pushed. Then, the engaging portion 144 is elastically deformed and is disengaged from the engaging opening 131*b*. In this state, the cover portion 144 of the cover member 142 is moved toward the rear side while being lifted up. The other end of the cover portion 143 is then removed from the engaging portion 103*b* formed on the front end wall 103, and the cover member 142 is removed.

Next, the new developing agent cartridge 150 is mounted on the predetermined position of the cover wall 105 constituting the developing housing 100 by a suitable fastening means. Then, the other end of the sealing member 152 mounted on the bottom surface of the bottom wall of the cartridge body 151 is positioned on the front side of the machine housing passing through the seal insertion port 131*a* formed in the lower part of the partitioning wall 131, passing over the seal-peeling guide member 141, above the space 134 constituting the toner-feeding portion 130, and through the seal insertion port 145*c* formed in the front end plate 145. Then, the cover member 142 is mounted.

After the new developing agent cartridge 150 is mounted on the developing housing 100 of the developing device 10 as described above, the developing device 10 on which the new developing agent cartridge 150 is mounted, is mounted in the machine housing 2 in the same manner as when the developing device 10 is replaced, and the other end of the sealing member 152 is pulled to peel the sealing member 152 off. After the toner-feeding device 300 is brought to the acting position, the front cover 2*a* mounted in front of the machine housing 2 is upwardly turned and is closed from the open state shown in FIG. 2, so that the copying operation can be carried out again. In the foregoing was described the operation for replacing the developing agent cartridge 150. However, the operation for replacing the developing agent cartridge 150 is not performed by a user but is performed by a service man. At the time of peeling the sealing member 152 off, it is not allowed to insert the screw driver or the like in the engaging opening 131*b* unless the developing agent cartridge 150 is removed from the predetermined position on the cover wall 105 constituting the developing housing 100 as described above. When the developing device 10 is to be replaced mounting the developing agent cartridge 150 thereon, therefore, the cover member 142 covering the upper side of the toner-feeding portion through which the sealing member 152 passes, is not removed. Therefore, the user does not have to remove the cover member 142 and does not have to encounter the probability of contamination. Thus, the likelihood of contamination is avoided that results when the cover member 142 is removed for replacing the developing device 10.

The image-forming machine and the developing device used for the image-forming machine of the present invention is constituted as described above, and exhibit the action and effect as described below.

That is, according to the present invention, the separator wall extending in the back-and-forth direction is provided on the bottom wall that constitutes the developing housing of the developing device, to partition the conveying passage in which the stirring/conveying means is disposed, and guide grooves are formed in the bottom surface of the bottom wall on which the separator wall is provided, the guide grooves extending from an end of the back side toward the front side and being fitted with the operation pins that constitute the push-operation mechanism of the developing device. The guide grooves exhibit two functions; i.e., work as elements for constituting the push-operation mechanism and as elements for constituting a guide mechanism, enabling the whole apparatus to be simply constructed and in a small size. Besides, since the guide grooves are formed at portions where the separator wall is provided to partition the conveying passage, there is no need to increase the thickness of the bottom wall of the developing housing in order to form the guide grooves.

What we claim is:

1. An image-forming machine comprising:

a machine housing;

a photosensitive material drum disposed in said machine housing;

a movable mounting plate disposed in said machine housing so as to be moved toward, and away from, said photosensitive material drum;

a developing device having a developing housing, a developing agent application means for applying a developing agent onto an electrostatic latent image formed on said photosensitive material drum disposed in said developing housing, and a stirring/conveying means for conveying the developing agent in said developing housing to said developing agent application means while stirring it, and is detachably mounted on said movable mounting plate from the front side of said machine housing; and a push-operation mechanism for moving said developing device and said movable mounting plate between a push position close to said photosensitive material drum and a push-release position moved away from said push position; wherein a separator wall is provided in the back-and-forth direction on the bottom wall that constitutes said developing housing of said developing device to partition a conveying passage in which said stirring/conveying means is disposed, and guide grooves are formed in the bottom surface of said bottom wall provided with said separator wall, said guide grooves extending from an end of the back side toward the front side; and operation pins constituting said push-operation mechanism are fitted into the guide grooves formed in the bottom wall constituting said developing housing through guide holes formed in said movable mounting plate.

2. A developing device for use in an image-forming machine, having a developing housing, a developing agent application means disposed in said developing housing, and a stirring/conveying means for conveying the developing agent in said developing housing to said developing agent application means while stirring it, said developing device for use in an image-forming machine being detachably mounted on a movable mounting plate disposed in a machine housing from the front side; wherein a separator wall is provided in the back-and-forth direction on the bottom wall that constitutes said developing housing of said developing device to partition a conveying passage in which said stirring/conveying means is disposed, and guide grooves are formed in the bottom surface of said bottom wall provided with said separator wall, said guide grooves extending from an end of the back side toward the front side and being fitted with operation pins that constitute a push-operation mechanism of said developing device.

* * * * *